US007654120B1

(12) United States Patent
Chen et al.

(10) Patent No.: US 7,654,120 B1
(45) Date of Patent: Feb. 2, 2010

(54) LOCKING ASSEMBLY AND ELECTRONIC DEVICE USING SAME

(75) Inventors: Chao-Jen Chen, Taipei Hsien (TW); Yu-Rong Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/400,776

(22) Filed: Mar. 9, 2009

(30) Foreign Application Priority Data

Oct. 20, 2008 (CN) ..... 2008 1 0305007

(51) Int. Cl.
*E05B 73/00* (2006.01)

(52) U.S. Cl. ..... 70/14; 70/18; 70/49; 70/58; 248/553

(58) Field of Classification Search ..... 70/14, 70/18, 30, 49, 58, 233; 248/551–553; 361/679.57, 361/679.58
See application file for complete search history.

(56) References Cited

U.S. PATENT DOCUMENTS 4,300,371 A * 11/1981 Herwick et al. ..... 70/58
4,811,577 A * 3/1989 Webster et al. ..... 70/14
4,934,649 A * 6/1990 Stout et al. ..... 248/551
5,406,809 A * 4/1995 Igelmund ..... 70/2
5,603,416 A * 2/1997 Richardson et al. ..... 211/70.6
5,709,110 A * 1/1998 Greenfield et al. ..... 70/58
5,768,920 A * 6/1998 DeBevoise ..... 70/18
6,163,326 A * 12/2000 Klein et al. ..... 345/156
6,427,499 B1 * 8/2002 Derman ..... 70/58
6,578,394 B2 * 6/2003 Yin ..... 70/58
6,941,777 B2 * 9/2005 Iwamoto ..... 70/69
7,191,623 B2 * 3/2007 Francke ..... 70/18
2007/0180872 A1 * 8/2007 Mahre et al. ..... 70/58

* cited by examiner

*Primary Examiner*—Lloyd A Gall
(74) *Attorney, Agent, or Firm*—Frank R. Niranjan

(57) ABSTRACT

A locking assembly is configured for locking an electronic device to an object. The electronic device includes a panel. The panel includes two opposite first and second surfaces. A first through hole, a second through hole and a third through hole are defined in the panel. The locking assembly includes a rotating wheel, a lockset and a flexible cable. The rotating wheel is rotatably coupled to the first surface. The lockset includes a lock cylinder and is fixed to the first surface. The lock cylinder is extended through the first through hole and exposed from the second surface. The flexible cable is wrapped around the rotating wheel, and includes a locking end and an opposite connecting end. The connecting end is fixed to the rotating wheel. The locking end is extended through the second through hole and the third through hole, and capable of being engaged with the lockset.

16 Claims, 6 Drawing Sheets

LOCKING ASSEMBLY AND ELECTRONIC DEVICE USING SAME

BACKGROUND

1. Technical Field

The disclosure relates to locking technology, and particularly, to a locking assembly and an electronic device using the same.

2. Description of the Related Art

Due to the small size of many modern electronic devices, such as laptops and display devices, a great concern exists for the physical security of such electronic devices. For example, in a business office or other commercial environment where people are coming and going, the threat of theft of such electronic devices is high, due to both the high cost of the electronic devices and the ease with which they can be concealed.

Therefore, a reliable security system or method for securing these electronic devices is needed.

DETAILED DESCRIPTION

Figure 1:
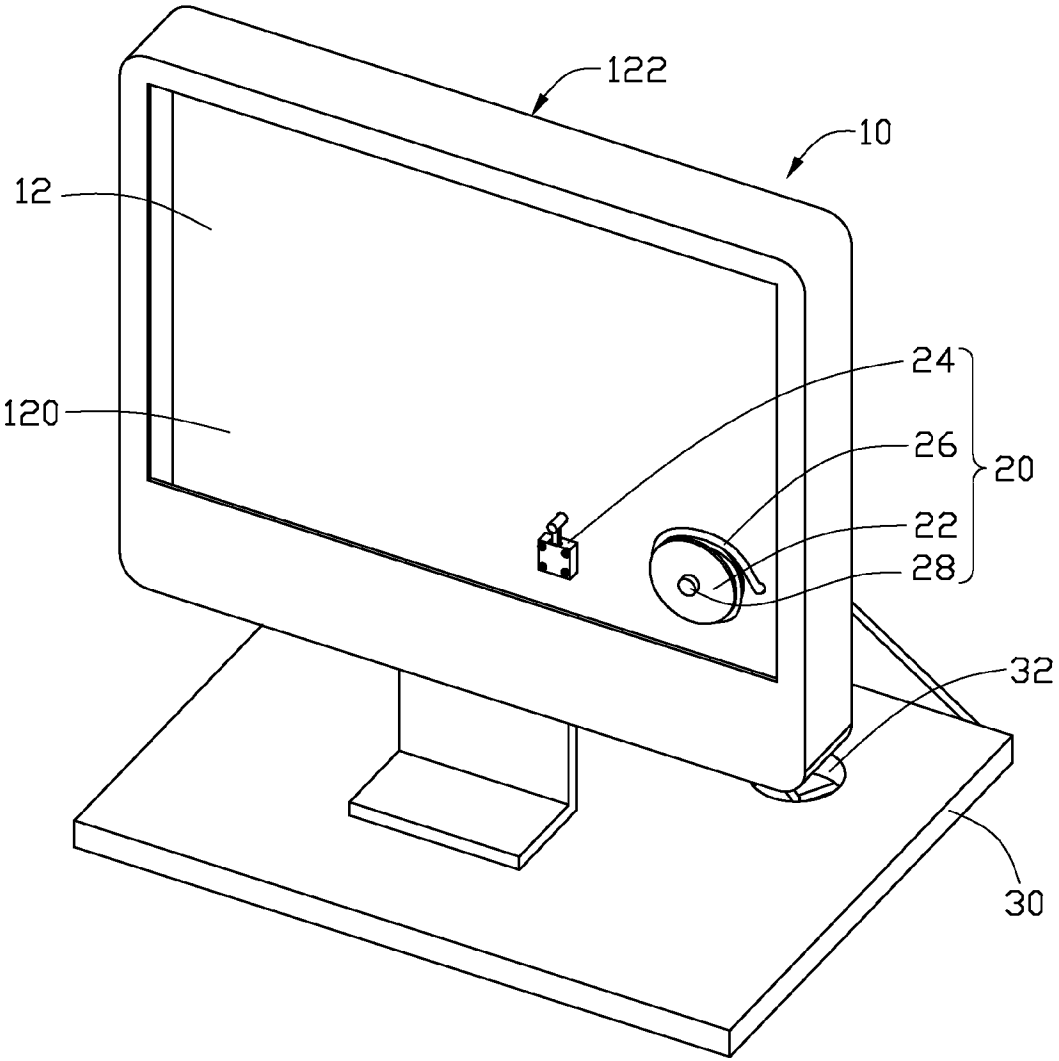
FIG. 1 is an isometric view of an electronic device including a locking assembly, according to an exemplary embodiment, showing the electronic device being locked, to an object, by the locking assembly.
Figure 2:
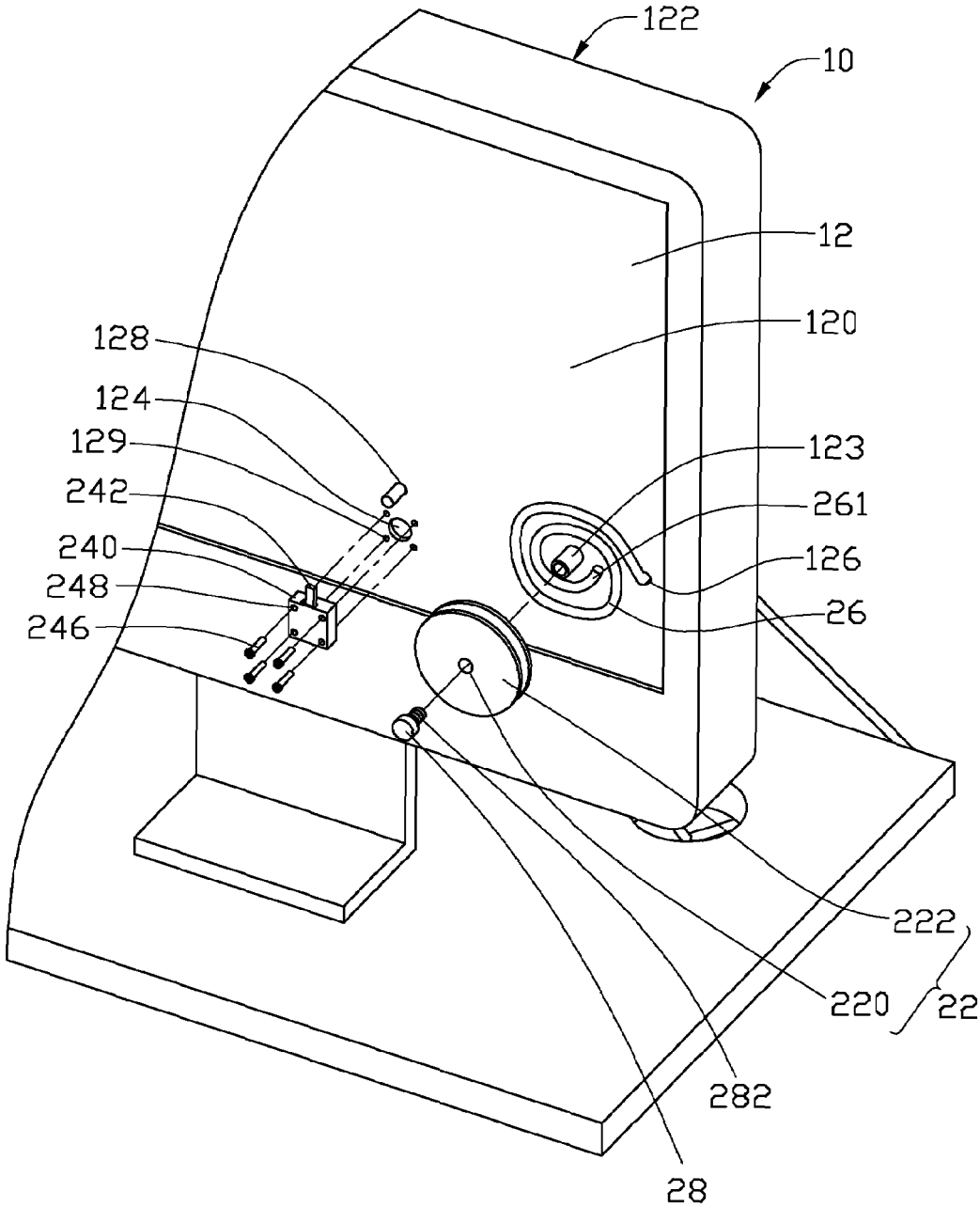
FIG. 2 is a partially exploded, isometric view of the locking assembly of FIG. 1.

Referring to FIGS. 1 and 2, an electronic device 10 according to an exemplary embodiment includes a panel 12, and a locking assembly 20. In this embodiment, the electronic device 10 is a display device.

The panel 12 includes two opposite first and second surfaces 120, 122. A fastener holder 123 is formed on the first surface 120. A first through hole 124, a second through hole 126, and a third through hole 128 are defined in the panel 12. The holes 124, 126, and 128 are all circular. Four first threaded holes 129 are defined in the panel 12 and are substantially equidistant from each other around the first through hole 124.

The locking assembly 20 includes a rotating wheel 22, a lockset 24, a flexible cable 26, and a first fastener 28 such as a screw, bolt or some other engaging means.

The rotating wheel 22 includes a hollow rotating shaft 220 and two restricting portions 222 radially extending from two ends of the rotating shaft 220 respectively. The internal diameter of the rotating shaft 220 is smaller than the external diameter of the fastener holder 123. The internal diameter of the rotating shaft 220 is slightly greater than the external diameter of a threaded rod 282 of the first fastener 28. The first fastener 28 is extended through the rotating shaft 220 and is engaged with the fastener holder 123 so that the rotating wheel 22 is rotatably mounted on the first fastener 28.

Figure 3:
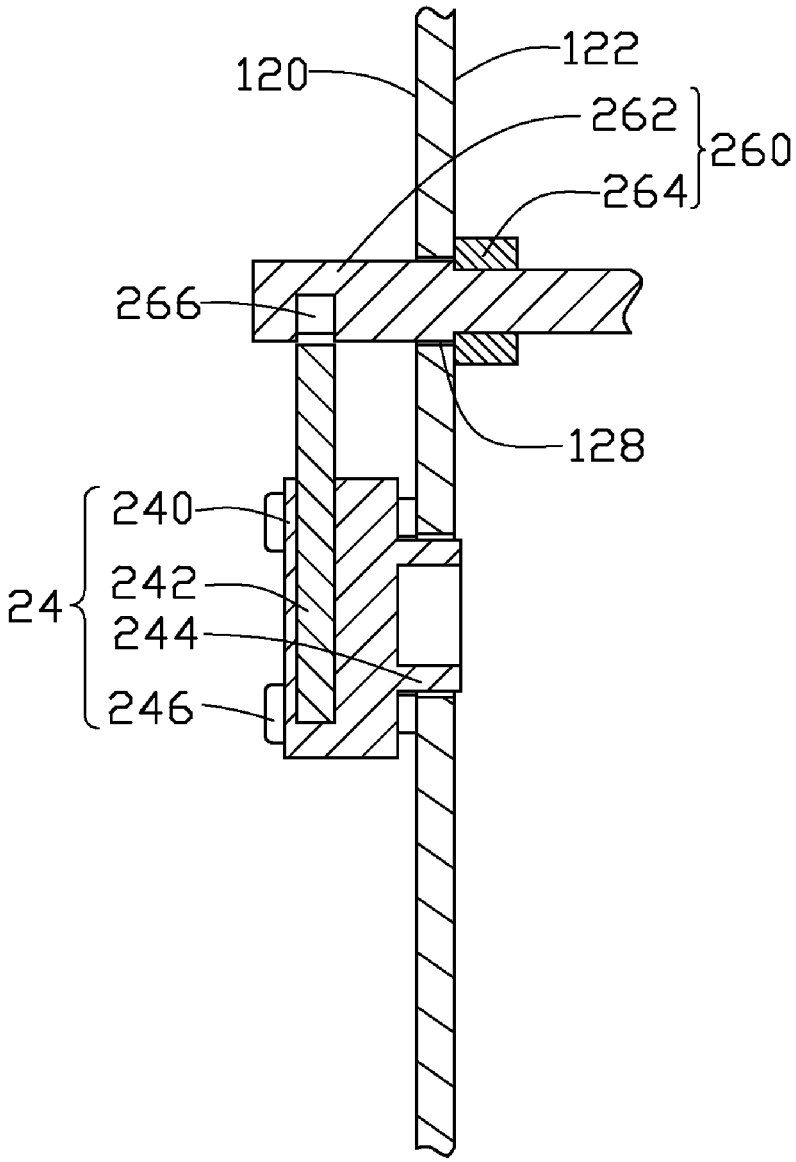
FIG. 3 is a partially enlarged, cross-sectional view of the locking assembly of FIG. 1.
Figure 4:
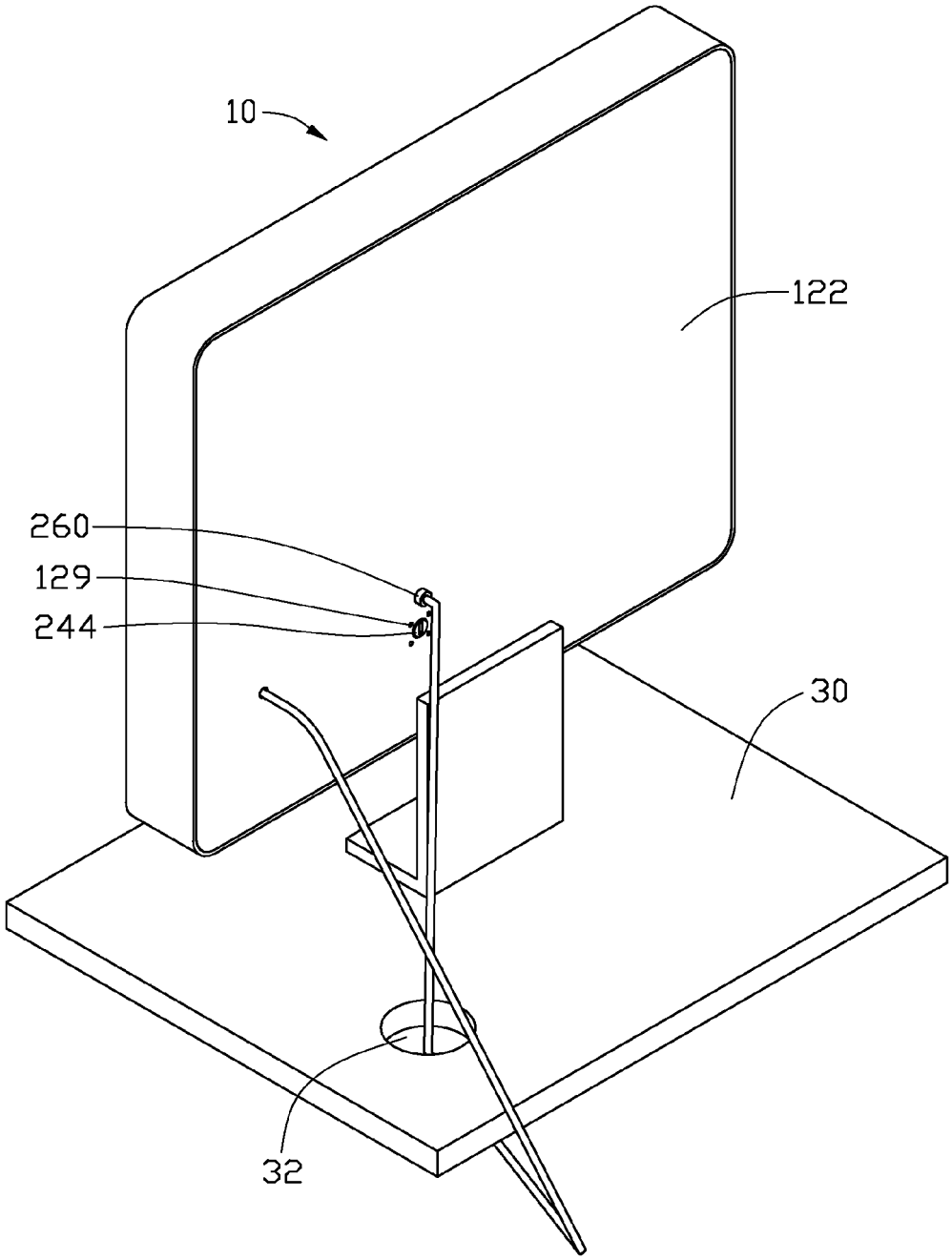
FIG. 4 is similar to FIG. 1, but viewing the electronic device from another angle.

Referring to FIGS. 2-4, the lockset 24 may be one of many types of locks. In this embodiment a lock that has a lock bolt 242 that can be extended or retracted by use of a key is described as an example. The lockset 24 includes a lock body 240, a lock bolt 242, a lock cylinder 244, and four second fasteners 246. Four second threaded holes 248 are symmetrically defined in the lock body 240 corresponding to the four first threaded holes 129 respectively. The lock bolt 242 is partially received in the lock body 240. The lock cylinder 244 perpendicularly protrudes from the lock body 240. Each second fastener 246 is extended through the second threaded hole 248 and is engaged in the first threaded hole 129 so that the lockset 24 is fixed to the first surface 120 of the panel 12. The lock bolt 242 is adjacent to the first surface 120. The lock cylinder 244 passes through the first through hole 124 and is exposed from the second surface 122.

The cable 26 is wrapped around the rotating shaft 220, and includes a locking end 260 and an opposite connecting end 261. The connecting end 261 is fixed to the rotating shaft 220 between the two restricting portions 222. The locking end 260 includes a cylinder body 262 and a cylinder stopping portion 264 extending from the body 262. A quadrate cavity 266 is defined in the locking end 260 corresponding to the lock bolt 242. The diameter of the stopping portion 264 is greater than that of the second through hole 126 and that of the third through hole 128 so that the stopping portion 264 contacts the second surface 122. The diameter of the body 262 is slightly smaller than that of the third through hole 128 so that the body 262 can be extended through the third through hole 128 to be engaged with the lock bolt 242 through the cavity 266.

Figure 5:
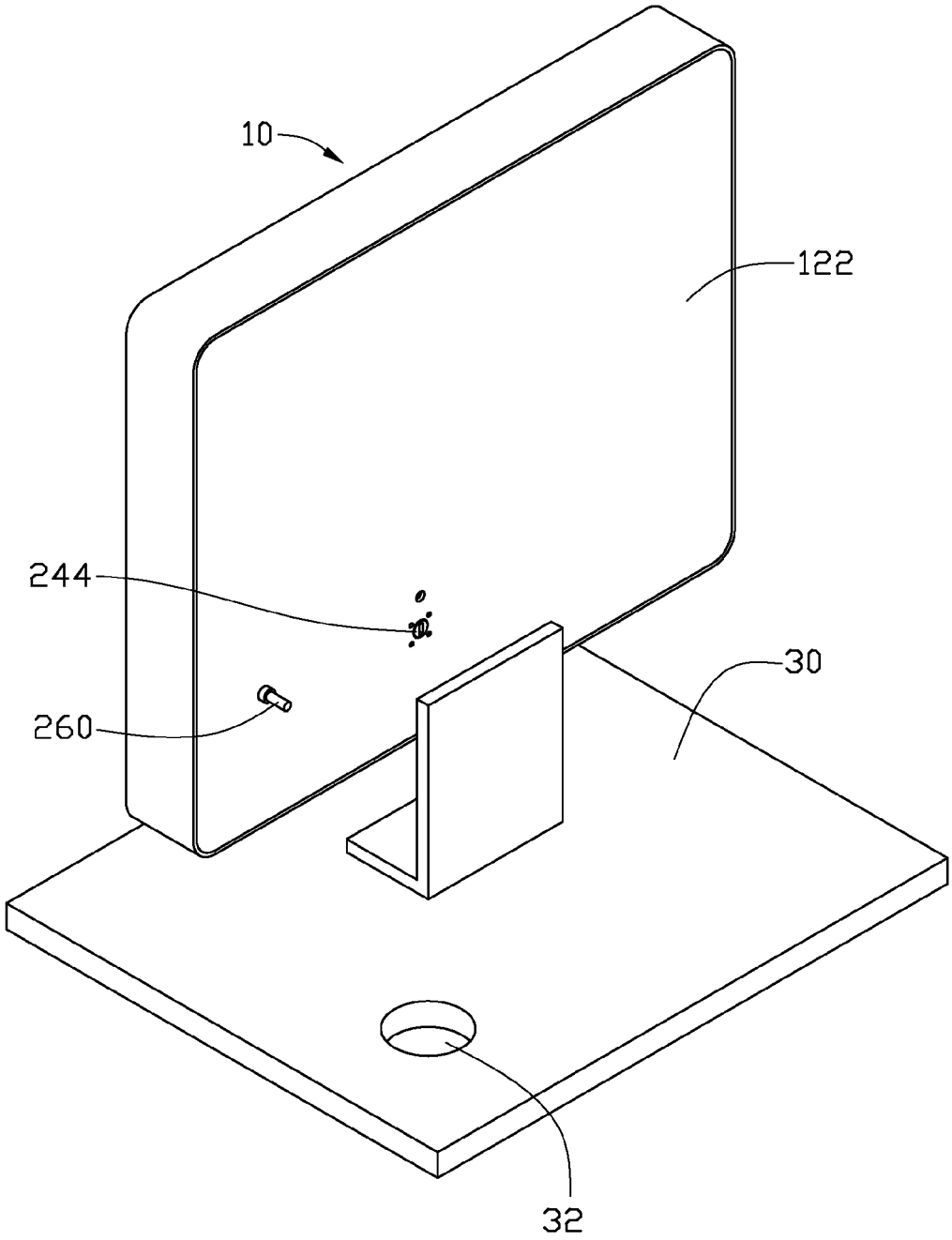
FIG. 5 is similar to FIG. 4, but showing the electronic device in an unlocked state.

When the display device 10 needs to be locked to an object such as a desk 30, the cable 26 is pulled out by a user via the locking end 260 and is extended through a through hole 32 defined in the desk 30. The body 262 is inserted into the panel 12 via the third through hole 128 and the lockset 24 is locked so that the lock bolt 242 is engaged with the body 262. Referring to FIG. 5, to release the display device 10 from the desk 30, the lockset 24 is unlocked so that the lock bolt 242 is retracted to release the body 262, the locking end 260 is drawn back automatically under tension of the cable 26 until the stopping portion 264 abuts against the second surface 122. In this way, the display device 10 can be conveniently secured to or released from the desk 30.

Figure 6:
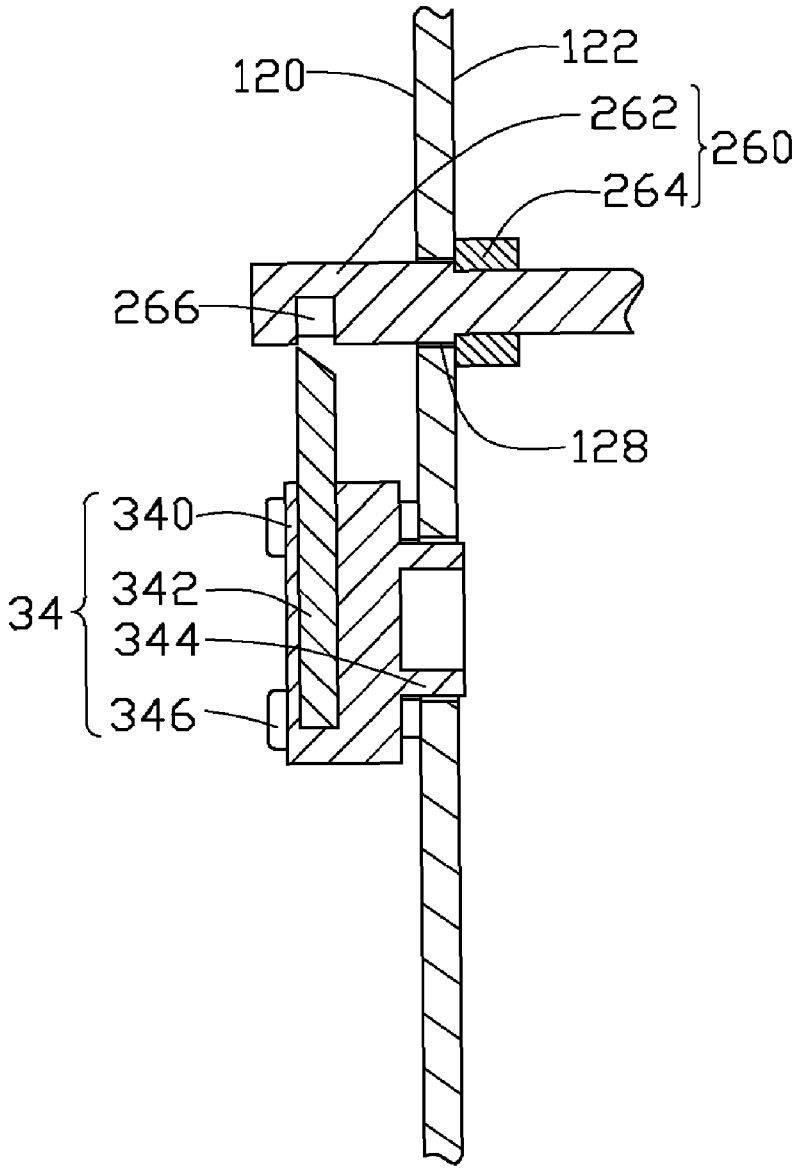
FIG. 6 is a partially enlarged, cross-sectional view of a locking assembly according to another exemplary embodiment.

Referring to FIG. 6, a lockset 34 according to another embodiment is shown. The difference between the lockset 34 of this embodiment and the lockset 24 (of FIG. 3) is that a latch bolt 342 of the lockset 34 is provided instead of the lock bolt 242. When the body 262 is extended through the third through hole 128 to abut against the latch bolt 342, the latch bolt 342 is pressed down by the body 262 with the further insertion of the body 262 until the latch bolt 342 meets the cavity 266. When the latch bolt 342 meets the cavity 266, the latch bolt 342 is released to engage with the body 262 so that the display device 10 is secured to the desk 30.

It is to be understood, however, that even though numerous characteristics and advantages of the present embodiments have been set fourth in the foregoing description, together with details of the structures and functions of the embodiments, the disclosure is illustrative only, and changes may be made in details, especially in matters of shape, size, and arrangement of parts within the principles of the invention to the full extent indicated by the broad general meaning of the terms in which the appended claims are expressed.

What is claimed is:

1. A locking assembly for locking an electronic device to an object, the electronic device comprising a panel, the panel comprising two opposite first and second surface, a first through hole, a second through hole, and a third through hole defined in the panel, the locking assembly comprising:

a rotating wheel rotatably coupled to the first surface;

a lockset fixed to the first surface, the lockset comprising a lock cylinder, the lock cylinder extended through the first through hole and exposed from the second surface; and a flexible cable wrapped around the rotating wheel, the flexible cable comprising a locking end and an opposite connecting end, the connecting end fixed to the rotating wheel, the locking end extended through the second through hole and the third through hole, and capable of being engaged with the lockset.

2. The locking assembly as claimed in claim 1, wherein the lockset further comprises a lock body and a lock bolt, the lock bolt is partially received in the lock body, the lock cylinder perpendicularly protrudes from the lock body, the locking end is extended through the third through hole and is engaged with the lock bolt.

3. The locking assembly as claimed in claim 1, wherein the lockset further comprises a lock body and a latch bolt, the latch bolt is partially received in the lock body, the lock cylinder perpendicularly protrudes from the lock body, the locking end is extended through the third through hole and is engaged with the latch bolt.

4. The locking assembly as claimed in claim 1, wherein the rotating wheel comprises a hollow rotating shaft and two restricting portions radially extending from the two ends of the rotating shaft, the connecting end is fixedly connected to the rotating shaft between the two restricting portions.

5. The locking assembly as claimed in claim 4, wherein a fastener holder is formed in the first surface, the locking assembly further comprises a first fastener, the internal diameter of the rotating shaft is smaller than the external diameter of the fastener holder, the first fastener is extended through the rotating shaft and is engaged with the fastener holder so that the rotating wheel is rotatably mounted on the first fastener.

6. The locking assembly as claimed in claim 5, wherein the internal diameter of the rotating shaft is slightly greater than the external diameter of a threaded rod of the first fastener.

7. The locking assembly as claimed in claim 1, wherein the lockset is fixed to the first surface by screw joint.

8. The locking assembly as claimed in claim 1, wherein the locking end comprises a body and a stopping portion extending from the body, the body is extended through the third through hole, the stopping portion abuts against the second surface.

9. An electronic device comprising:

a panel comprising two opposite first and second surface, a first through hole, a second through hole, and a third through hole defined in the panel; and a locking assembly comprising:

a rotating wheel rotatably coupled to the first surface;

a lockset fixed to the first surface, the lockset comprising a lock cylinder, the lock cylinder extended through the first through hole and exposed from the second surface; and a flexible cable wrapped around the rotating wheel, the flexible cable comprising a locking end and an opposite connecting end, the connecting end fixed to the rotating wheel, the locking end extended through the second through hole and the third through hole, and capable of being engaged with the lockset.

10. The electronic device as claimed in claim 9, wherein the lockset further comprises a lock body and a lock bolt, the lock bolt is partially received in the lock body, the lock cylinder perpendicularly protrudes from the lock body, the locking end is extended through the third through hole and is engaged with the lock bolt.

11. The electronic device as claimed in claim 9, wherein the lockset further comprises a lock body and a latch bolt, the latch bolt is partially received in the lock body, the lock cylinder perpendicularly protrudes from the lock body, the locking end is extended through the third through hole and is engaged with the latch bolt.

12. The electronic device as claimed in claim 9, wherein the rotating wheel comprises a hollow rotating shaft and two restricting portions radially extending from the two ends of the rotating shaft, the connecting end is fixedly connected to the rotating shaft between the two restricting portions.

13. The electronic device as claimed in claim 12, wherein a fastener holder is formed in the first surface, the locking assembly further comprises a first fastener, the internal diameter of the fastener holder is smaller than the external diameter of the fastener holder, the rotating shaft is extended through the rotating shaft and is engaged with the fastener holder so that the rotating wheel is rotatably mounted on the first fastener.

14. The electronic device as claimed in claim 13, wherein the internal diameter of the rotating shaft is slightly greater than the external diameter of a threaded rod of the first fastener.

15. The electronic device as claimed in claim 9, wherein the lockset is fixed to the first surface by a screw joint.

16. The electronic device as claimed in claim 9, wherein the locking end comprises a body and a stopping portion extending from the body, the body is extended through the third through hole, the stopping portion abuts against the second surface.

* * * * *